US006698314B1

(12) United States Patent
Nichols

(10) Patent No.: US 6,698,314 B1
(45) Date of Patent: Mar. 2, 2004

(54) AIR BRAKE SLACK ADJUSTING TOOL

(76) Inventor: James J. Nichols, 2445 Jones St., Deckerville, MI (US) 48427

( * ) Notice: Subject to any disclaimer, the term of this patent is extended or adjusted under 35 U.S.C. 154(b) by 0 days.

(21) Appl. No.: 10/171,788

(22) Filed: Jun. 17, 2002

(51) Int. Cl.[7] ..... B25B 13/00

(52) U.S. Cl. ..... 81/58; 81/58.1; 81/58.4; 81/456; 81/424.5; 81/426; 81/426.5; 81/420

(58) Field of Search ..... 81/58, 58.1, 58.4, 81/456, 424.5, 426, 426.5, 420; 7/125, 138

(56) References Cited

U.S. PATENT DOCUMENTS 1,321,777 A * 11/1919 Stepanian ..... 81/165
4,899,445 A * 2/1990 Erbrick et al. ..... 30/251
4,974,478 A * 12/1990 Wolff ..... 81/456
6,199,458 B1 * 3/2001 Wrigley et al. ..... 81/319

* cited by examiner

*Primary Examiner*—Joseph J. Hail, III
*Assistant Examiner*—Alvin J. Grant

(57) ABSTRACT

An air brake slack adjusting tool for pushing in the locking collar on a slack adjuster bolt. The air brake slack adjusting tool includes a first elongate member having a handle portion and a slack adjuster portion; and also includes a second elongate member being pivotally attached to the first elongate member and having a handle portion and a support portion; and further includes a ratcheting mechanism being disposed in the slack adjuster portion for engaging a locking collar on an air brake.

1 Claim, 2 Drawing Sheets

AIR BRAKE SLACK ADJUSTING TOOL

BACKGROUND OF THE INVENTION

1. Field of the Invention

The present invention relates to hand tools for adjusting slack in air brakes and more particularly pertains to a new air brake slack adjusting tool for pushing in the locking collar on a slack adjuster bolt.

2. Description of the Prior Art

The use of hand tools for adjusting slack in air brakes is known in the prior art. More specifically, hand tools for adjusting slack in air brakes heretofore devised and utilized are known to consist basically of familiar, expected and obvious structural configurations, notwithstanding the myriad of designs encompassed by the crowded prior art which have been developed for the fulfillment of countless objectives and requirements.

The prior art includes inventions having pliers with handles and with various styles of working end portions. While these devices fulfill their respective, particular objectives and requirements, the aforementioned prior art do not disclose a new air brake slack adjusting tool.

SUMMARY OF THE INVENTION

The general purpose of the present invention, which will be described subsequently in greater detail, is to provide a new air brake slack adjusting tool which has many of the advantages of the hand tools for adjusting slack in air brakes mentioned heretofore and many novel features that result in a new air brake slack adjusting tool which is not anticipated, rendered obvious, suggested, or even implied by any of the prior art hand tools for adjusting slack in air brakes, either alone or in any combination thereof. The present invention includes a first elongate member having a handle portion and a slack adjuster portion; and also includes a second elongate member being pivotally attached to the first elongate member and having a handle portion and a support portion; and further includes a ratcheting mechanism being disposed in the slack adjuster portion for engaging a locking collar on an air brake. None of the prior art includes the combination of elements of the present invention.

There has thus been outlined, rather broadly, the more important features of the air brake slack adjusting tool in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new air brake slack adjusting tool which has many of the advantages of the hand tools for adjusting slack in air brakes mentioned heretofore and many novel features that result in a new air brake slack adjusting tool which is not anticipated, rendered obvious, suggested, or even implied by any of the prior art hand tools for adjusting slack in air brakes, either alone or in any combination thereof.

Still another object of the present invention is to provide a new air brake slack adjusting tool for pushing in the locking collar on a slack adjuster bolt.

Still yet another object of the present invention is to provide a new air brake slack adjusting tool that is easy and convenient to use.

Even still another object of the present invention is to provide a new air brake slack adjusting tool that eliminates having to use a hammer and a box end wrench.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
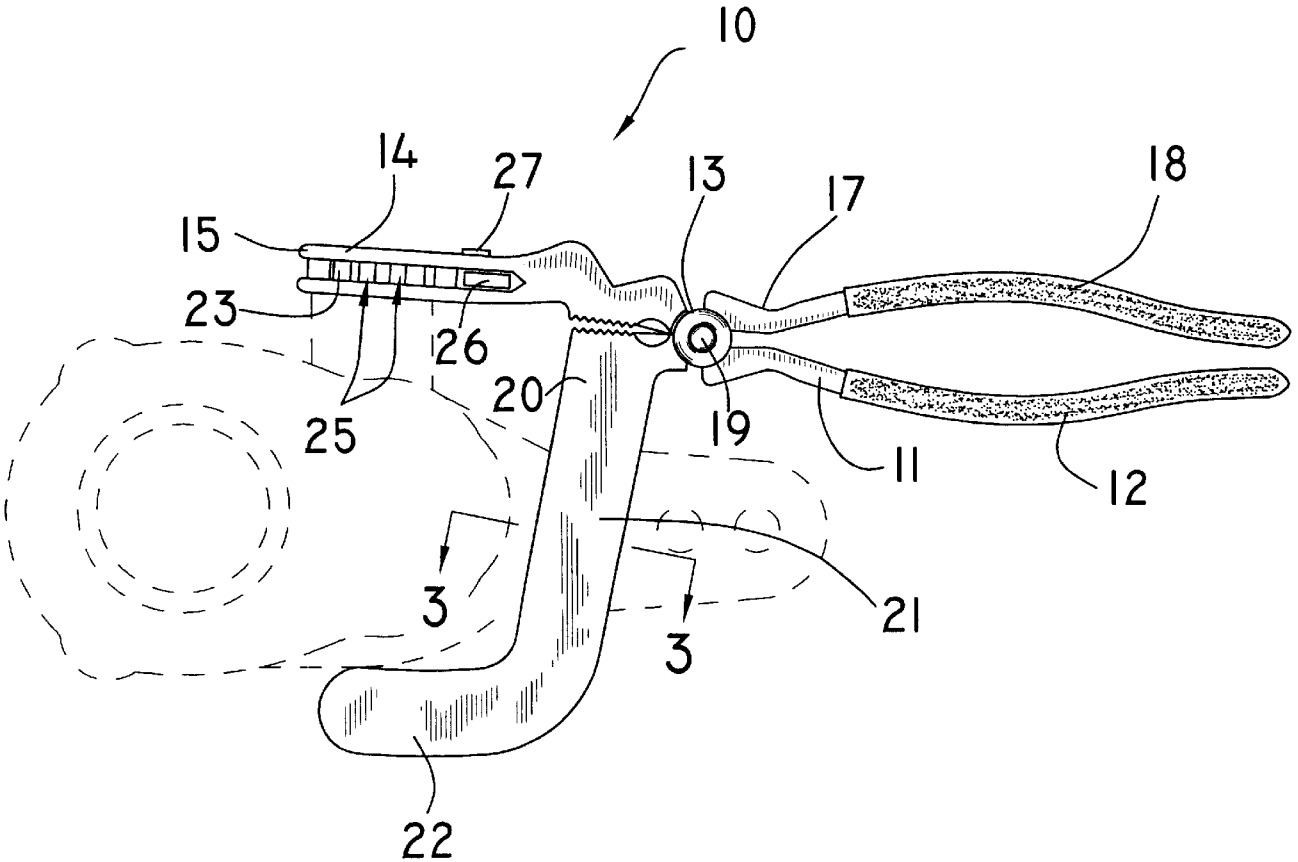
FIG. 1 is a side elevational view of a new air brake slack adjusting tool according to the present invention.
Figure 2:
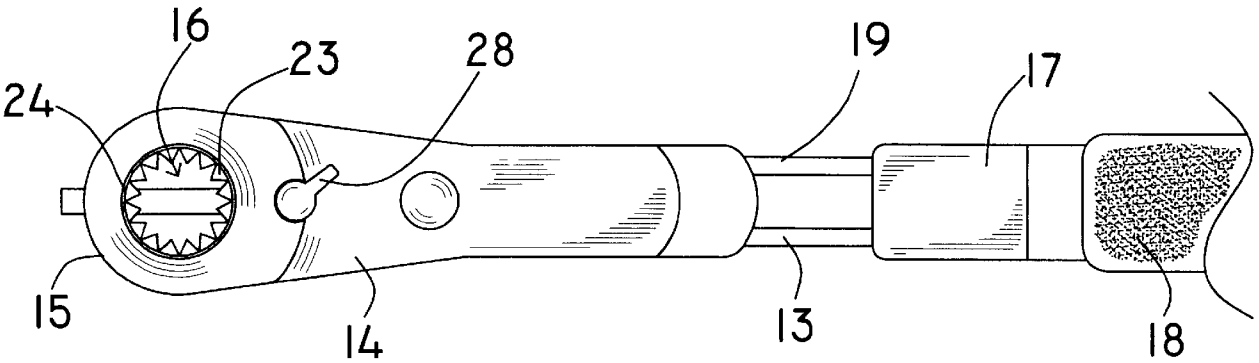
FIG. 2 is a partial top plan view of the present invention.
Figure 3:
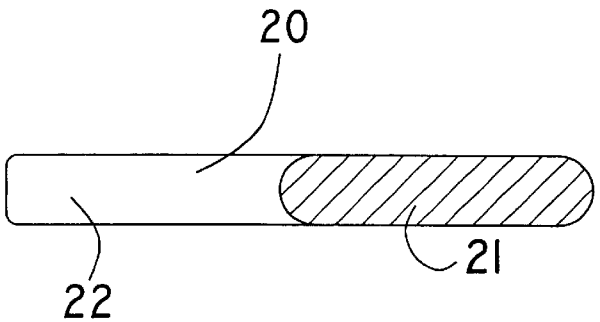
FIG. 3 is a cross-sectional view of the arm member of the present invention.

With reference now to the drawings, and in particular to FIGS. 1 through 3 thereof, a new air brake slack adjusting tool embodying the principles and concepts of the present invention and generally designated by the reference numeral 10 will be described.

As best illustrated in FIGS. 1 through 3, the air brake slack adjusting tool 10 generally comprises a first elongate member 11 having a first handle portion 12 and a slack adjuster portion 14. The first elongate member 11 also has a first pivot 13 being integrally disposed generally intermediate of the first handle portion 12 and the slack adjuster portion 14. The slack adjuster portion 14 has a rounded outer end 15 and a collar-receiving opening 16 being disposed therethrough near the rounded outer end 15 and having an axis which is generally disposed approximately ninety degrees from an axis of the first pivot 13.

A second elongate member 17 is-pivotally and conventionally attached to the first elongate member 11 and has a second handle portion 18 and a support portion 20. The second elongate member 17 also has a second pivot 19 being integrally disposed generally intermediate of the second handle portion 18 and the support portion 20 with the first and second pivots 13,19 being pivotally and conventionally fastened to one another. The first and second handle portions 12,18 of the first and second elongate members 11,17 are generally disposed in a plane and are bowed generally away from one another and also pivot toward and away from one another. The support portion 20 of the second elongate member 17 has an elongate main portion 21 being extended away from the slack adjuster portion 14 of the first elongate member 11 and being angled relative to the second handle portion 18 and having an end being integrally attached to the second pivot 19, and also has an elongate end portion 22 which is integrally attached to and angled relative to the elongate main portion 21 and which extends away from and parallel to the second handle portion 18 for engaging an air brake.

A ratcheting mechanism is conventionally disposed in the slack adjuster portion 14 for engaging a locking collar on an air brake. The ratcheting mechanism includes a ring member 23 being rotatably and conventionally retained in the collar-receiving opening 16 of the slack adjuster portion 14 of the first elongate member 11 and having a plurality of slots 25 being spacedly disposed in an outer side of the ring member 23 and also having a plurality of teeth 24 being conventionally disposed end-to-end upon an inner side of the ring member 23 for gripping a locking collar of the air brake, and also includes a pawl-like wheel 26 being conventionally and rotatably disposed in the slack adjuster portion 14 of the first elongate member 11 and being engagable in the slots 25 of the ring member 23, and further includes a two-way pawl locking member 27 being conventionally attached to the pawl-like wheel 26 and having a key 28 being pivotally and conventionally disposed upon the slack adjuster portion 14 for selecting rotational direction of the ring member 23 and the pawl-like wheel 26.

In use, the user pivots the support portion 20 away from the slack adjuster portion 14 with the elongate end portion 22 of the support portion 20 being engaged about the air brake and the ring member 23 being engaged about the locking collar. The user moves the locking collar about the slack adjuster bolt of the air brake.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the air brake slack adjusting tool. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air brake slack adjusting tool comprising:

a first elongate member having a first handle portion and a slack adjuster portion, said first elongate member also having a first pivot being disposed generally intermediate of said first handle portion and said slack adjuster portion;

a second elongate member being pivotally attached to said first elongate member and having a second handle portion and a support portions said second elongate member also having a second pivot being disposed generally intermediate of said second handle portion and said support portion with said first and second pivots being pivotally fastened to one another; and a ratcheting mechanism being disposed in said slack adjuster portion for engaging a locking collar on an air brake, said slack adjuster portion having a rounded outer end and a collar-receiving opening being disposed therethrough near said rounded outer end and having an axis which is generally disposed approximately ninety degrees from an axis of said first pivot, said ratcheting mechanism including a ring member being rotatably retained in said collar-receiving opening of said slack adjuster portion of said first elongate member and having a plurality of slots being spacedly disposed in an outer side of said ring member and also having a plurality of teeth being disposed end-to-end upon an inner side of said ring member for gripping a locking collar of the air brake, and also including a pawl-like wheel being disposed in said slack adjuster portion of said first elongate member and being engageable in said slots of said ring member, and further including a two-way pawl locking member being attached to said pawl-like wheel and having a key being pivotally disposed upon said slack adjuster portion for selecting rotational direction of said ring member and said pawl-like wheel.

* * * * *